US007682005B2

(12) United States Patent
Ramakrishnan

(10) Patent No.: US 7,682,005 B2
(45) Date of Patent: Mar. 23, 2010

(54) INK TANK CONFIGURED TO ACCOMMODATE HIGH INK FLOW RATES

(75) Inventor: Bhaskar Ramakrishnan, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 630 days.

(21) Appl. No.: 11/563,832

(22) Filed: Nov. 28, 2006

(65) Prior Publication Data

US 2008/0122910 A1 May 29, 2008

(51) Int. Cl.
*B41J 2/175* (2006.01)

(52) U.S. Cl. ..... 347/86

(58) Field of Classification Search ..... 347/85, 347/86, 87, 49

See application file for complete search history.

(56) References Cited

U.S. PATENT DOCUMENTS 5,552,816 A * 9/1996 Oda et al. ..... 347/86
5,790,158 A * 8/1998 Shinada et al. ..... 347/86
6,659,599 B2 * 12/2003 Putman et al. ..... 347/86
6,766,817 B2 7/2004 da Silva
6,918,404 B2 7/2005 Dias da Silva
6,966,642 B2 * 11/2005 Hanaoka et al. ..... 347/86
7,066,586 B2 6/2006 da Silva
7,185,977 B2 * 3/2007 Kyogoku et al. ..... 347/86
7,285,255 B2 10/2007 Kadlec et al.
2007/0268344 A1 11/2007 Anderson et al.

* cited by examiner

*Primary Examiner*—Anh T. N. Vo

(57) ABSTRACT

A removable ink tank configured to be mounted to a printhead assembly includes a floor having an ink output port A free ink chamber is located above the floor. A suspended ink chamber is located above the floor and around the ink output port. The suspended ink chamber is separated from the free ink chamber. At least one ink suspension body is contained in the suspended ink chamber. A fluid communication port is formed between the free ink chamber and the suspended ink chamber to facilitate a fluid communication between the free ink chamber and the suspended ink chamber. A filter device is positioned to cover the fluid communication port. The filter device has a porosity selected to establish a desired bubbling pressure between the free ink chamber and the suspended ink chamber.

22 Claims, 6 Drawing Sheets

INK TANK CONFIGURED TO ACCOMMODATE HIGH INK FLOW RATES

BACKGROUND OF THE INVENTION

1. Field of the Invention

The present invention relates to an ink tank, and, more particularly, to an ink tank with features to regulate bubbling pressure, so as to accommodate high ink flow rates at a desirable backpressure.

2. Description of the Related Art

An ink jet printer forms an image on a print medium, such as paper, by applying ink on the print medium. The ink may be contained in one or more replaceable supply cartridges. Examples of such replaceable supply cartridges include a replaceable ink tank and a replaceable ink jet printhead cartridge. A replaceable ink jet printhead cartridge, for example, includes both an ink tank and an ink jet micro-fluid ejection device, i.e., a printhead, in a unitary package. In contrast, a replaceable ink tank does not include the micro-fluid ejection device, but rather, the micro-fluid ejection device forms part of a printhead assembly that is separately attached to the printhead carrier.

A typical ink tank includes a free ink chamber separated by a dividing wall from a suspended ink chamber, which is also sometimes referred to as a felt chamber. The felt chamber has inserted therein the felt ink suspending member having pores for retaining ink. The divider wall between the free ink chamber and the felt chamber has an ink communication port, sometimes referred to in the art as a "bubbler window", to allow transfer of air and ink between the two chambers. The term "bubbling" refers to the process of air and liquid exchange through the ink communication port, i.e., the bubbler window. Air enters the free ink chamber, which in turn allows ink from the free ink chamber to move into the felt chamber.

Bubbling pressure is the pressure at which an air and liquid exchange occurs through the ink communication port, i.e., bubbler window. In prior art ink tanks, the felt in the felt chamber dictates the bubbling pressure. For example, the bubbling pressure is dependant upon the porosity of the felt, erg., the length through which the ink must travel before reaching the wick that transfers ink from the ink tank to the printhead assembly, since ink flow resistance increases as length increases, and vice-versa. Thus, the bubbling pressure has been difficult to regulate with any consistency.

SUMMARY OF THE INVENTION

The present invention provides an ink tank with features to regulate bubbling pressure, so as to accommodate high ink flow rates at a desirable backpressure.

The terms "first" and "second" preceding an element name, e.g., first side wall, second side wall, first floor portion, second floor portion, etc., are used for identification purposes to distinguish between similar elements, and are not intended to necessarily imply order, nor are the terms "first" and "second" intended to preclude the inclusion of additional similar elements.

The invention, in one form thereof, is directed to a removable ink tank configured to be mounted to a printhead assembly installed on an imaging apparatus. The removable ink tank includes a floor having an ink output port. A free ink chamber is located above the floor. A suspended ink chamber is located above the floor and around the ink output port. The suspended ink chamber is separated from the free ink chamber. At least one ink suspension body is contained in the suspended ink chamber. A fluid communication port is formed between the free ink chamber and the suspended ink chamber to facilitate a fluid communication between the free ink chamber and the suspended ink chamber. A filter device is positioned to cover the fluid communication port. The filter device has a porosity selected to establish a desired bubbling pressure between the free ink chamber and the suspended ink chamber.

The invention, in another form thereof, is directed to an imaging apparatus. The imaging apparatus includes a print engine having a printhead carrier. A printhead assembly is mounted to the printhead carrier. A removable ink tank is configured to be mounted to the printhead assembly. The removable ink tank includes a floor including an ink output port. A free ink chamber is located above the floor. A suspended ink chamber is located above the floor and around the ink output port. The suspended ink chamber is separated from the free ink chamber. At least one ink suspension body is contained in the suspended ink chamber. A fluid communication port is formed between the free ink chamber and the suspended ink chamber to facilitate a fluid communication between the free ink chamber and the suspended ink chamber. A filter device is positioned to cover the fluid communication port. The filter device has a porosity selected to establish a desired bubbling pressure between the free ink chamber and the suspended ink chamber.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate embodiments of the invention, and such exemplifications are not to be construed as limiting the scope of the invention in any manner.

DETAILED DESCRIPTION OF THE INVENTION

Figure 1:
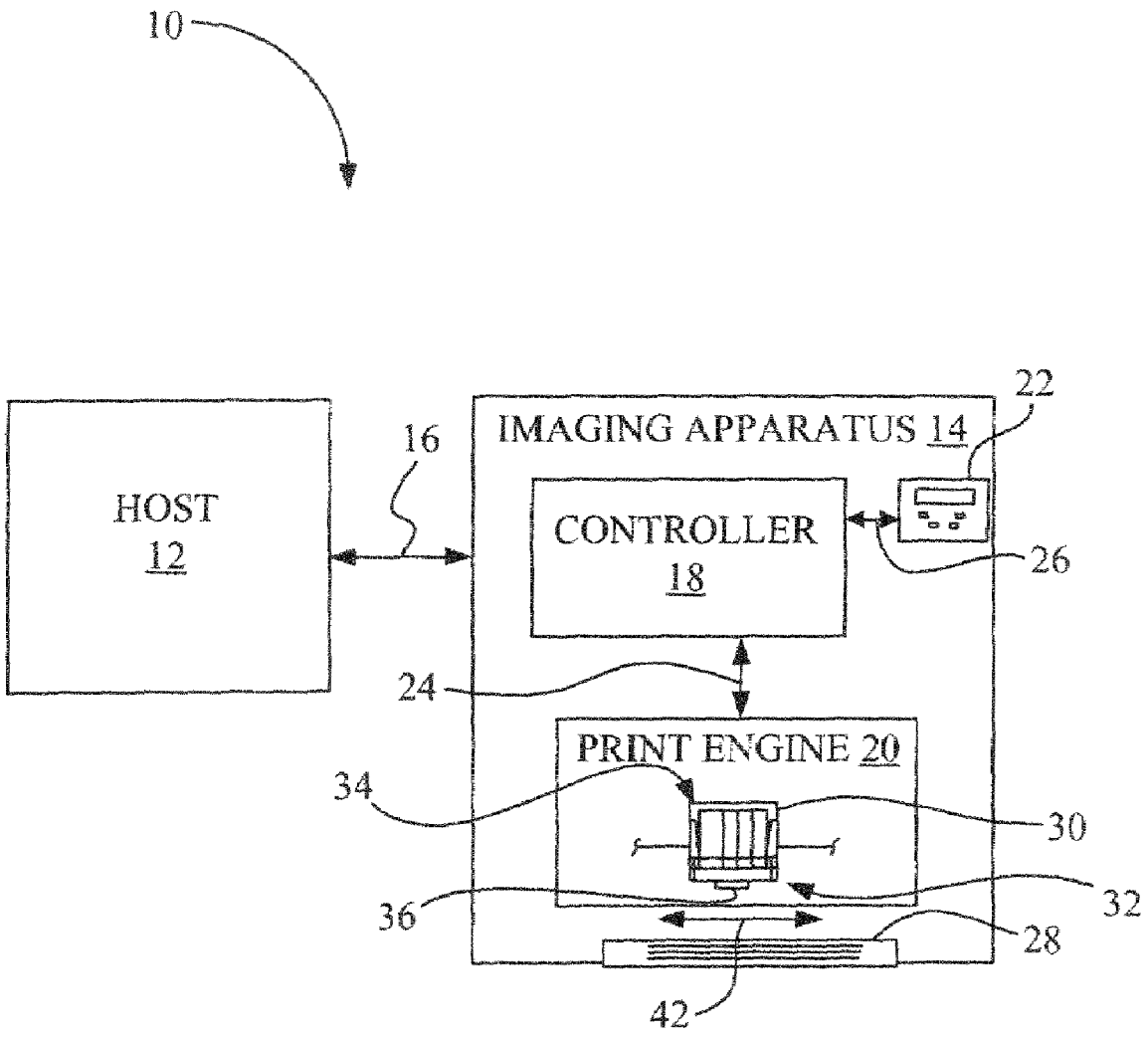
FIG. 1 is a diagrammatic depiction of an imaging system embodying the present invention.

FIG. 1 shows a diagrammatic depiction of an imaging system 10 embodying the present invention, Imaging system 10 may include a host 12 and an imaging apparatus 14. Imaging apparatus 14 communicates with host 12 via a communications link 16. Communications link 16 may be established by a direct cable connection, wireless connection or by a network connection such as for example an Ethernet local area network (LAN).

Alternatively, imaging apparatus 14 may be a standalone unit that is not communicatively linked to a host, such as host 12. For example, imaging apparatus 14 may take the form of an all-in-one, i.e., multifunction, machine that includes standalone copying and facsimile capabilities, in addition to optionally serving as a printer when attached to a host, such as host 12.

Host 12 may be, for example, a personal computer including an input/output (I/O) device, such as keyboard and display monitor. Host 12 further includes a processor, input/output (I/O) interfaces, memory, such as RAM, ROM, NVRAM, and a mass data storage device, such as a hard drive, CD-ROM and/or DVD units. During operation, host 12 may include in its memory a software program including program instructions that function as an imaging driver, e.g., printer driver software, for imaging apparatus 14. Alternatively, the imaging driver may be incorporated, in whole or in part, in imaging apparatus 14.

In the embodiment of FIG. 1, imaging apparatus 14 includes a controller 18, a print engine 20 and a user interface 22.

Controller 18 includes a processor unit and associated memory, and may be formed as an Application Specific Integrated Circuit (ASIC). Controller 18 communicates with print engine 20 via a communications link 24. Controller 18 communicates with user interface 22 via a communications link 26. Communications links 24 and 26 may be established, for example, by using standard electrical cabling or bus structures, or by wireless connection.

Print engine 20 may be, for example, an ink jet print engine configured for forming an image on a sheet of print media 28, such as a sheet of paper, transparency or fabric. Print engine 20 may include, for example, a reciprocating printhead carrier 30.

Figure 2:
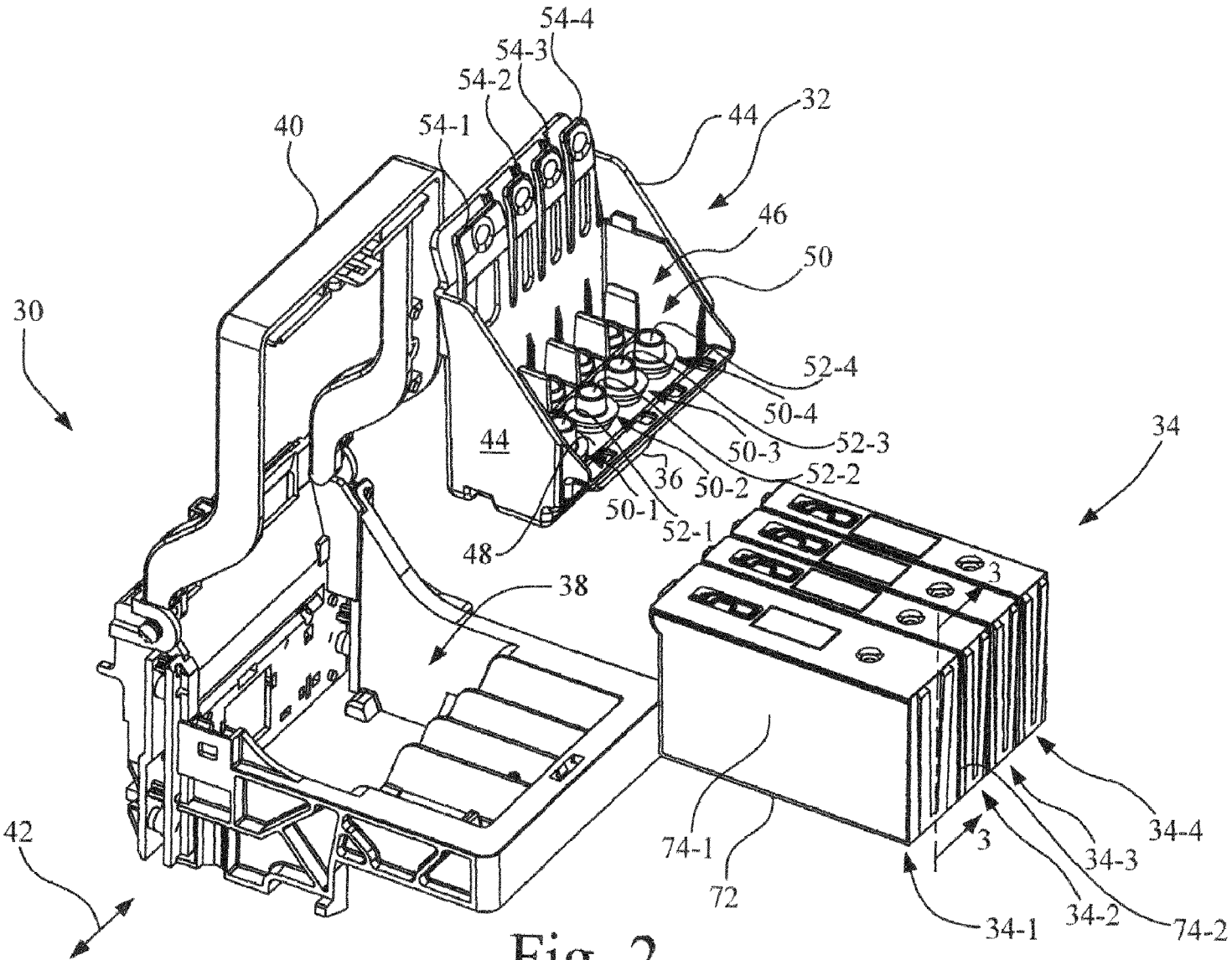
FIG. 2 is a perspective view of the printhead carrier of FIG. 1, with the printhead assembly and ink tanks uninstalled.

FIG. 2 shows in a perspective view printhead carrier 30, with a printhead assembly 32 and a plurality of removable ink tanks 34 in an uninstalled state. Printhead carrier 30 is mechanically and electrically configured to mount and carry at least one printhead assembly 32 that includes at least one ink jet micro-fluid ejection device 36. Printhead assembly 32 is mounted into position to printhead carrier 30 by inserting printhead assembly 32 into a cavity 38 in printhead carrier 30, and is latched in position by a mounting lever 40. Printhead carrier 30 transports printhead assembly 32, and in turn ink jet micro-fluid ejection device 36, in a reciprocating manner in a bi-directional main scan direction, i.e., axis, 42 over an image surface of the sheet of print media 28 during a printing operation.

Printhead assembly 32 is configured to mount and carry the plurality of removable ink tanks 34, and to facilitate an ink transfer from one or more of the plurality of removable ink tanks 34 to micro-fluid ejection device 36. The plurality of removable ink tanks 34 may be made, for example, from plastic. The plurality of ink tanks 34 are individually identified as ink tanks 34-1, 34-2, 34-3 and 34-4, and may include a monochrome ink tank containing black ink, and three color ink tanks containing cyan, magenta, and yellow inks. Micro-fluid ejection device 36 may include an ink jet nozzle array for each color of ink.

Printhead assembly 32 includes a printhead body 44 and a filter cap 46. Micro-fluid ejection device 36 is attached to a snout portion of printhead body 44. Filter cap 46 is attached to printhead body 44 via a hermetic seal, such as by welding or adhesive attachment. Filter cap 46 has a filter cap body 48 configured with a plurality of ink receiving devices 50, individually identified as ink receiving device 50-1, ink receiving device 50-2, ink receiving device 50-3, and ink receiving device 50-4. Each ink receiving device 50-1, 50-2, 50-3, and 50-4 includes a respective wick 52-1, 52-2, 52-3, and 52-4 that operably engages and facilitates fluid communication with the respective ink output ports of ink tanks 34-1, 34-2, 34-3 and 34-4, respectively. Each of wicks 52-1, 52-2, 52-3, and 52-4 may be constructed from a porous material, such as for example, from a porous felt material or a porous foam material. Ink tanks 34-1, 34-2, 34-3 and 34-4 are individually mounted to printhead assembly 32 via individual latches 54-1, 54-2, 54-3 and 54-4.

Figure 3:
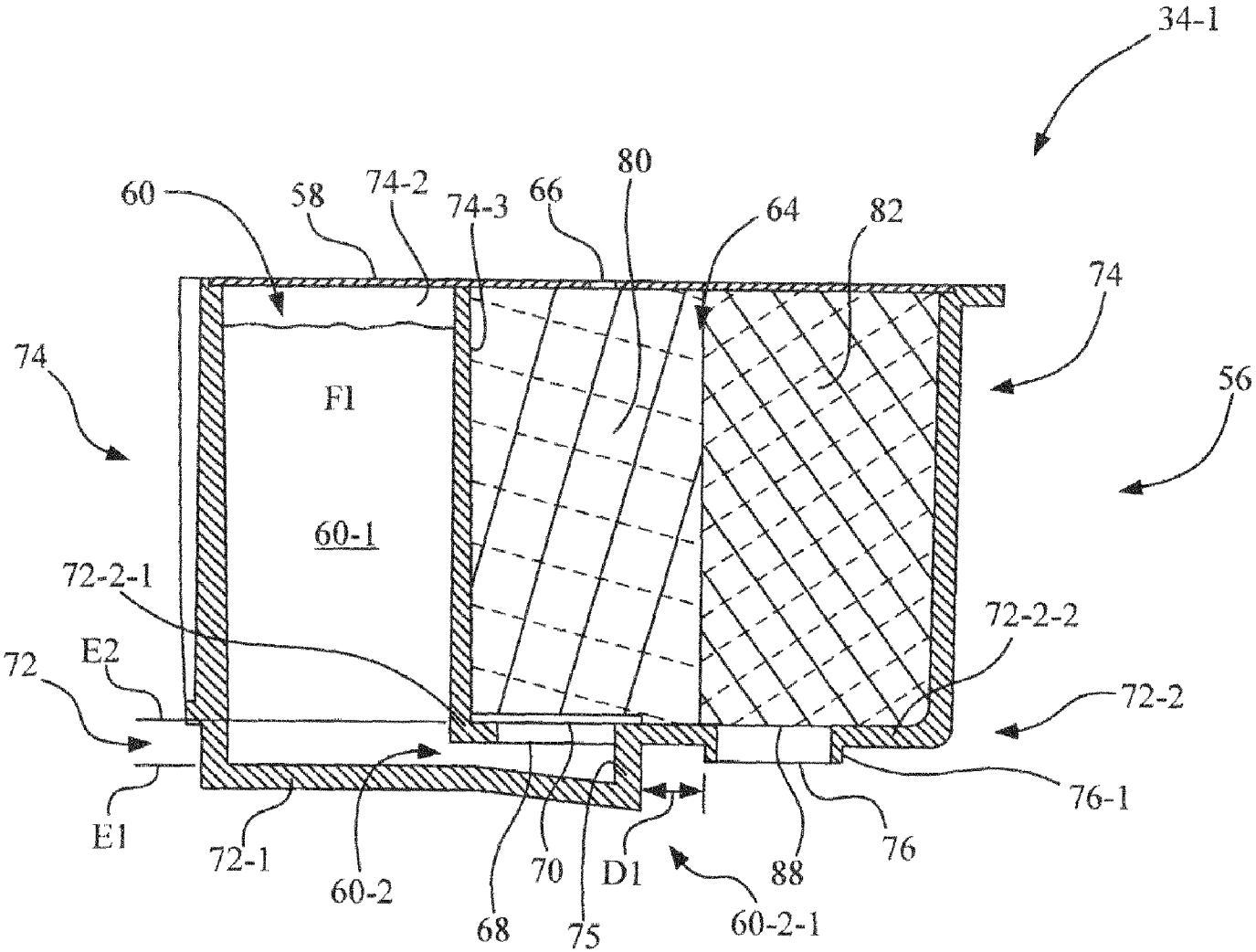
FIG. 3 is a sectional view of one of the removable ink tanks of FIG. 2 taken along line 3-3, with the ink tank uninstalled.

FIG. 3 is a sectional view of one of the removable ink tanks 34 taken along line 3-3 of FIG. 2, using ink tank 34-1 as an example. Each of removable ink tanks 34 are similar in design, varying only in size in the present embodiment. Accordingly, for convenience and ease of discussion, the following description will specifically reference ink tank 34-1, but those skilled in the art will recognize that the description may be applied equally to each of ink tank 34-2, ink tank 34-3, and ink tank 34-4.

Ink tank 34-1 includes a reservoir body 56 and a lid 58. Reservoir body 56 defines a free ink chamber 60 and a suspended ink chamber 64. A vent 66 located in lid 58 permits air flow from the atmosphere external to ink tank 34-1 into suspended ink chamber 64. A fluid communication port 68 and filter device 70 facilitate a controlled fluid communication between free ink chamber 60 and suspended ink chamber 64. In particular, filter device 70 covers over fluid communication port 68 and controls the bubbling pressure, i.e., the pressure at which air and liquid exchange through the fluid communication port 68, between free ink chamber 60 and suspended ink chamber 64, in contrast to the prior art which relies on the felt in the suspended ink chamber to control the bubbling pressure.

Ink tank 34-1 has a floor 72, and a plurality of side walls 74 extending upwardly away from floor 72. The plurality of side walls 74 include, for example, a first side wall 74-1 parallel to and spaced apart from a second side wall 74-2. Floor 72 includes a first floor portion 72-1 and a second floor portion 72-2. First floor portion 72-1 of floor 72 forms the floor of free ink chamber 60. Second floor portion 72-2 of floor 72 forms the floor of suspended ink chamber 64. As can be best seen in FIG. 3, a first elevation E1 of first floor portion 72-1 at free ink chamber 60 is lower than a second elevation E2 of second floor portion 72-2 of suspended ink chamber 64.

Free ink chamber 60 contains a free-flowing supply of ink FI, and is positioned adjacent to suspended ink chamber 64. Free ink chamber 60 is separated from suspended ink chamber 64 by a divider wall 74-3 and a sub-portion 72-2-1 of second floor portion 72-2. Divider wall 74-3 is interposed between and connected perpendicularly to each of side wall 74-1 and side wall 74-2.

In the present embodiment, free ink chamber 60 has an L-shape in cross-section defined by a vertical chamber portion 60-1 and a horizontal chamber portion 60-2. As shown in the embodiment of FIG. 3, horizontal chamber portion 60-2 extends under second floor portion 72-2 of suspended ink chamber 64, with sub-portion 72-2-1 of second floor portion 72-2 forming a ceiling over horizontal chamber portion 60-2. An end wall 75 extending from first floor portion 72-1 of floor 72 of free ink chamber 60 to second floor portion 72-2 of suspended ink chamber 64 of horizontal chamber portion 60-2 closes off, i.e., terminates, an outwardly protruding end 60-2-1 of horizontal chamber portion 60-2.

Sub-portion 72-2-1 of second floor portion 72-2 has a fluid communication port 68 to facilitate fluid communication between free ink chamber 60 and suspended ink chamber 64. In addition, an ink output port 76 is formed through a sub-portion 72-2-2 of second floor portion 72-2 of floor 72. Ink output port 76 facilitates fluid communication with printhead assembly 32 when ink tank 34-1 is installed on printhead assembly 32. Ink output port 76 is defined, in part, by a snout 76-1 extending downwardly from floor sub-portion 72-2-2. A distance D1 between outwardly protruding end 60-2-1 of horizontal chamber portion 60-2 and snout 76-1 serves as a keying feature in association with the docking configuration of printhead assembly 32, so as to identify a particular model of ink tank 34 that is deemed to be compatible with printhead assembly 32.

In accordance with the present invention, a filter device 70 is positioned over fluid communication port 68, and forms a porous structure to thereby form a restriction to define a bubbling pressure, i.e., a pressure at which air and liquid exchange through the fluid communication port 68, and thus prevents a free-flow of ink from free ink chamber 60 to suspended ink chamber 64. The porosity, i.e., the pore size in association with pore density, of filter device 70 is selected to establish a desired bubbling pressure at filter device 70, i.e., between free ink chamber 60 and suspended ink chamber 64, at a desired sustained ink flow rate. The desired bubbling pressure may be a pressure selected in a range of about 4 to 10 $cmH_2O$. In general, the sustained ink flow rate may be increased by increasing an opening size of fluid communication port 68, and in turn increasing the surface area of filter device 70 to increase the ink/air interface size. Filter device 70 may be, for example, a stainless steel mesh screen, a plastic mesh screen, or a porous plate.

Figure 4:
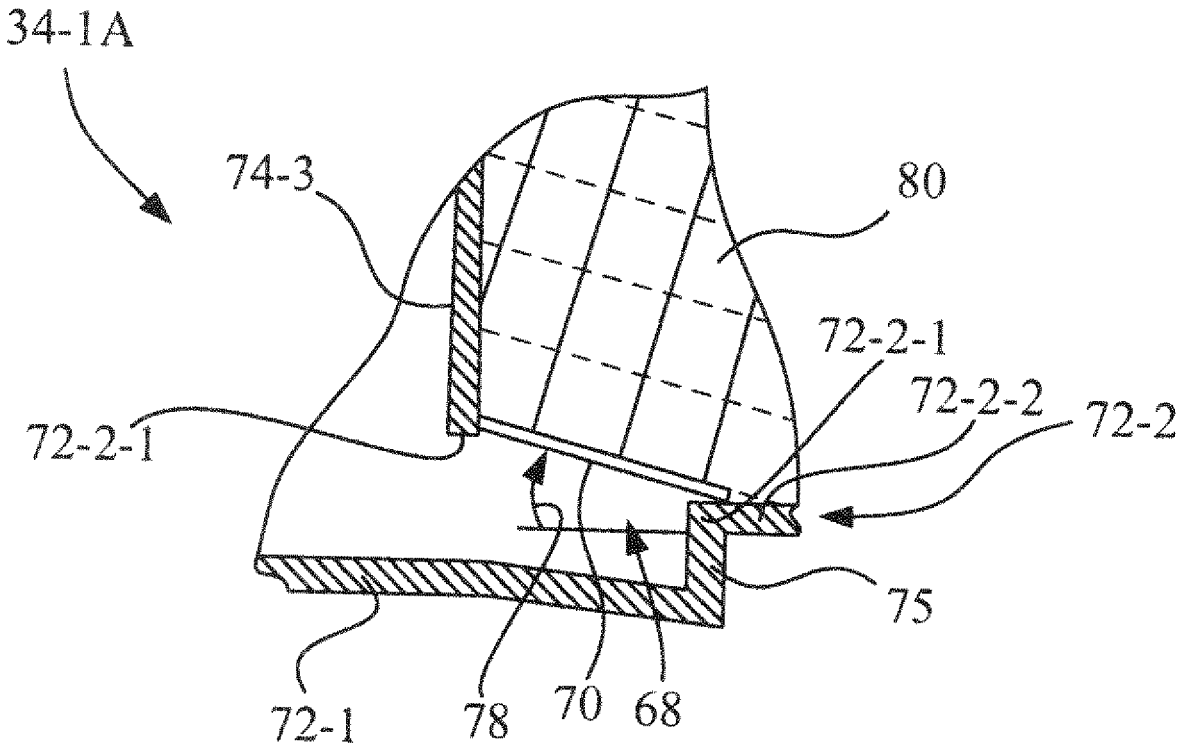
FIG. 4 is a sectional view of a portion of an alternative embodiment of the removable ink tank of FIG. 3.

FIG. 4 shows another embodiment of ink tank 34-1, identified as ink tank 34-1A, wherein filter device 70 is positioned at an angle 78 greater than zero with respect to horizontal, and in the embodiment shown, filter device 70 is positioned at angle 78 with respect to sub-portion 72-2-1 of second floor portion 72-2. Positioning filter device 70 at angle 78 serves to prevent air bubbles from accumulating under filter device 70 and completely blocking filter device 70 from ink flow. In the embodiment shown, for example, angle 78 may be about 12 degrees, e.g., 12 degrees from horizontal. However, angle 78 may range from 0 degrees to 90 degrees, wherein in embodiments approaching 90 degrees, the fluid communication port 68 would be moved from floor 72 to divider wall 74-3.

Referring again to the embodiment of FIG. 3, suspended ink chamber 64 contains ink suspension bodies 80 and 82 arranged in a side-by-side arrangement. Each of ink suspension bodies 80 and 82 may be formed, for example, from a felt material, to provide a pressure differential, i.e., backpressure, in suspended ink chamber 64 between filter device 70 and ink output port 76 to prevent a free-flow of ink out of suspended ink chamber 64 and through ink output port 76. Ink suspension body 80 may be, for example, a low pressure body 80, and ink suspension body 82 may be, for example, a high pressure body 82.

As ink is expelled from suspended ink chamber 64 via ink output port 76, the backpressure is increased in suspended ink chamber 64. For example, when the pressure in suspended ink chamber 64 becomes less than the bubbling pressure defined by filter device 70, then ink flows from free ink chamber 60 to suspended ink chamber 64, and air flows from vent 66 through fluid communication port 68 into free ink chamber 60.

Each of low pressure body 80 and high pressure body 82 may be constructed from a porous material, such as for example, from a porous felt material or a porous foam material. The porosity, i.e., the pore size in association with pore density, of high pressure body 82 is smaller than the porosity of low pressure body 80. The porosity differential may be achieved, for example, by way of the design of the physical pore size, e.g., pore diameter and or length, of the respective low pressure body 80 and high pressure body 82. As a more specific example, low pressure body 80 may be formed from a low-density felt (e.g., 0.12 g/cc) and high pressure body 82 may be formed from a high density felt (e.g., 0.15 g/cc).

Alternatively, the porosity differential may be achieved by providing a higher amount of compression of high pressure body 82 relative to the amount of compression on low pressure body 80, e.g., by the force exerted by side walls 74, floor 72 and lid 58 at suspended ink chamber 64 on the respective ink suspension bodies 80, 82.

In the embodiment of FIG. 3, low pressure body 80 is positioned in suspended ink chamber 64 adjacent to divider wall 74-3, and is positioned adjacent to and above filter device 70. As shown in the embodiment of FIG. 3, low pressure body 80 is not positioned adjacent to ink output port 76. High pressure body 82 is positioned in suspended ink chamber 64 adjacent to and in contact with low pressure body 80, and is positioned adjacent to and above ink output port 76.

Figure 5:
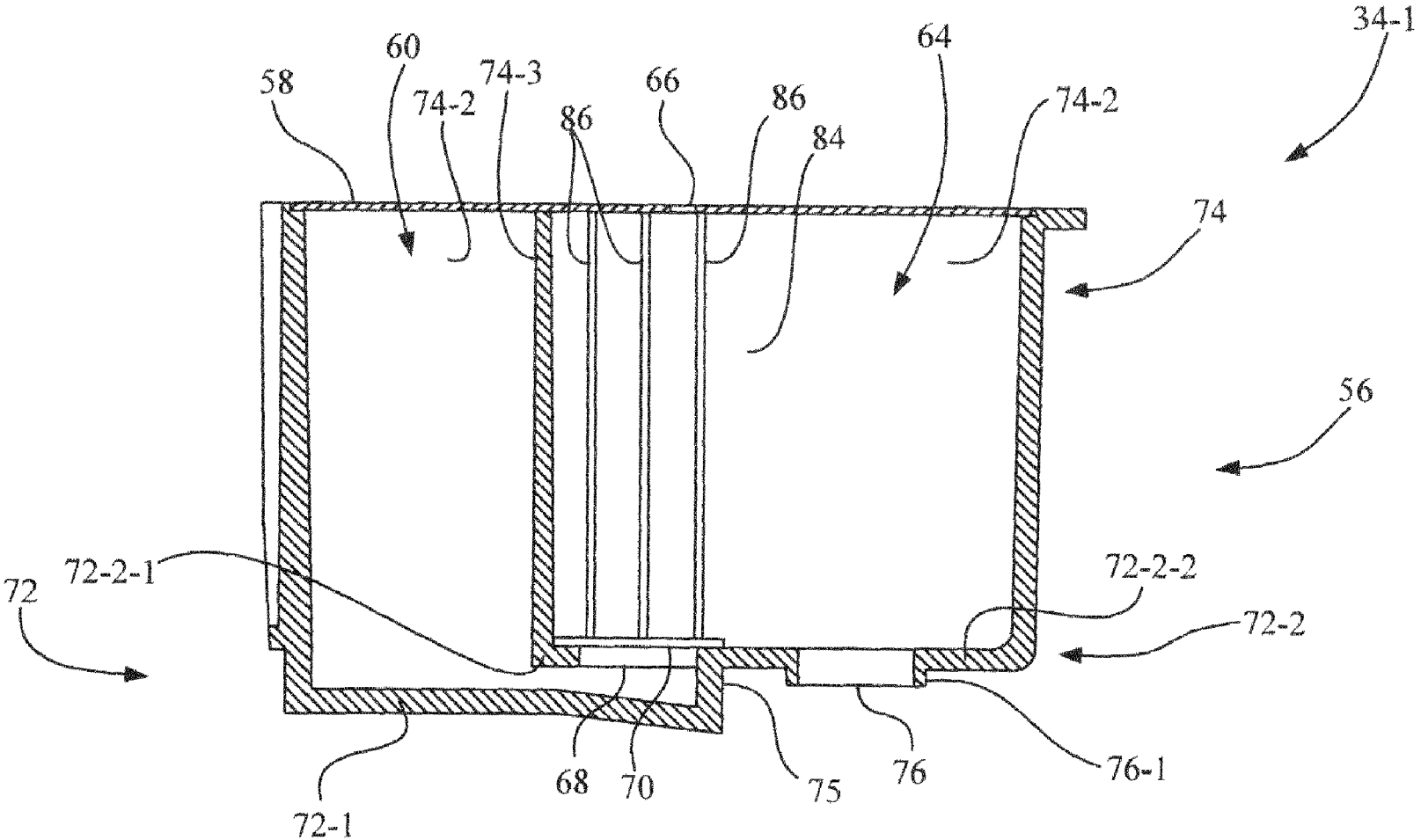
FIG. 5 is a sectional view corresponding to the removable ink tank of FIG. 3, with the ink suspension bodies removed to expose the side wall grooves.

FIG. 5 shows ink tank 34-1 of FIG. 3, with ink suspension bodies 80, 82 removed to expose an inner surface 84 of side wall 74-2. In suspended ink chamber 64, side wall 74-2 has at least one groove 86, i.e., a recessed channel, extending from second floor portion 72-2 near filter device 70 to lid 58 near vent 66. The groove(s) 86 provide an air path from near vent 66 to near filter device 70 to assist in accommodating high flow rates of ink out of ink output port 76 by permitting more air to flow from vent 66 into free ink chamber 60. The distance from groove(s) 86 to filter device 70 may be used in selecting the backpressure in suspended ink chamber 64. Grooves 86 may be of a multitude of configurations, including but not limited to straight, curved, tapered, vertical, and serpentine, etc. Alternatively, ribs may also perform the same function as grooves 86 to form an air path.

In one implementation, for example, the bubbling pressure and backpressure may be defined for ink tank 34-1 such that ink in suspended ink chamber 64 will be almost completely drained before free ink in free ink chamber 60 begins to drain into suspended ink chamber 64. The presence of grooves 86 assist in increasing the rate at which free ink FI in free ink chamber 60 drains into suspended ink chamber 64.

Referring again to FIG. 3, high pressure body 82 has a porous ink transfer surface 88 positioned adjacent to and above ink output port 76, which is engaged and deflected by ink receiving device 50-1 and its associated wick 52-1 (see FIG. 2) when ink tank 34-1 is installed in printhead assembly 32.

Figure 6:
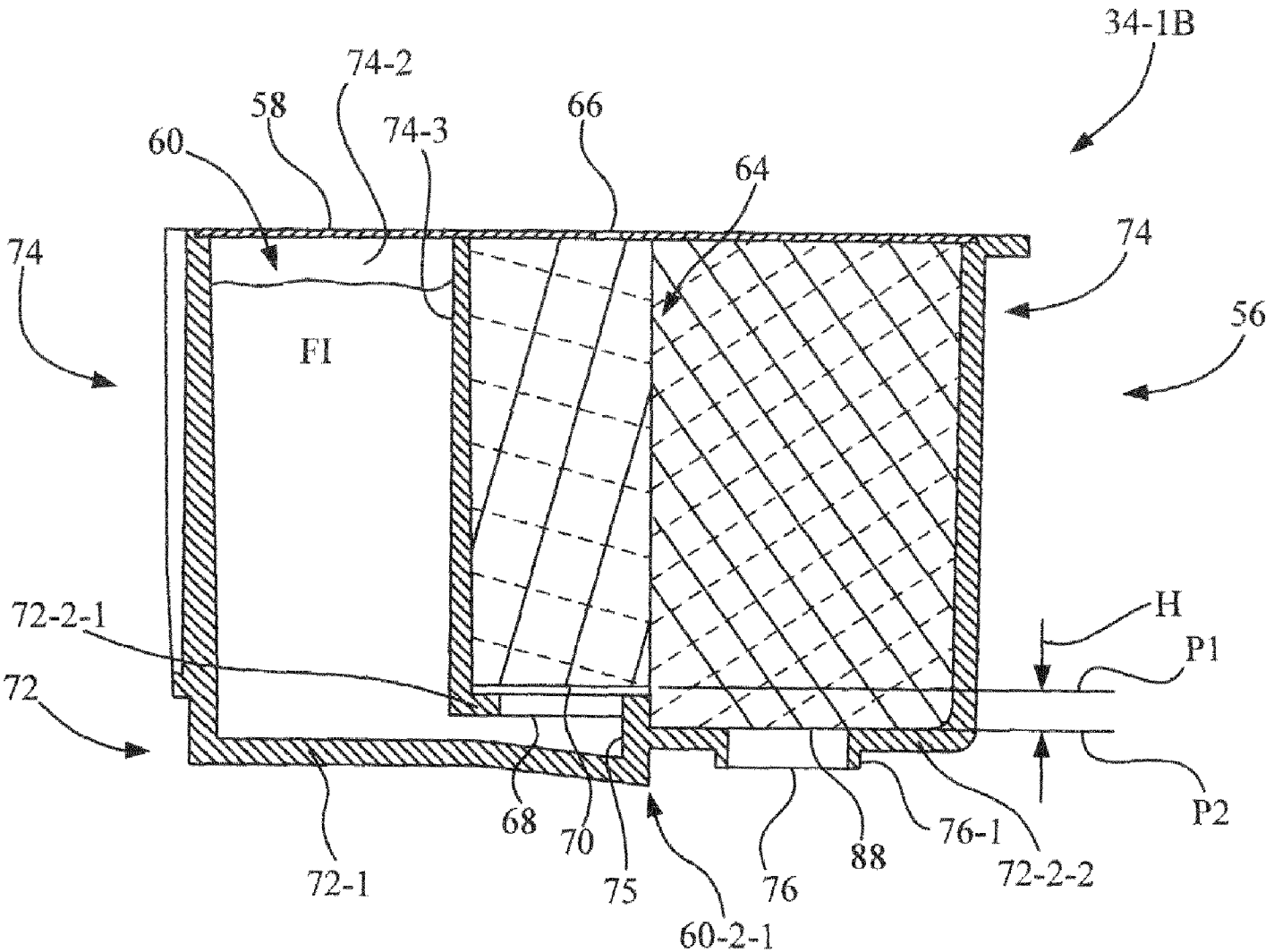
FIG. 6 is a sectional view of another alternative embodiment of the removable ink tank of FIG. 3.

In the embodiment of FIG. 3, the height of filter device 70 and ink transfer surface 88 are substantially on the same horizontal plane as defined by second floor portion 72-2. In contrast, in the alternative embodiment of FIG. 6 identified as ink tank 34-1B, filter device 70 is oriented along a plane P1 and ink transfer surface 88 of high pressure body 82 is oriented along a plane P2. Plane P1 and plane P2 are substantially parallel, and plane P1 is separated from plane P2 by a height H. Increasing the height H at which filter device 70 contacts low pressure body 80 relative to the elevation of ink transfer surface 88 of high pressure body 82 changes the system capacitance, and in turn increases the instantaneous ink flow rate burst amount available from ink output port 76, i.e., increases the ink flow rate burst amount for a finite duration. Accordingly, during the design of ink tanks 34, the height H of filter device 70 above ink transfer surface 88 of high pressure body 82 may be selected to define the desired ink flow rate burst amount of suspended ink chamber 64.

While this invention has been described with respect to embodiments of the invention, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A removable ink tank configured to be mounted to a printhead assembly installed on an imaging apparatus comprising:

floor having an ink output port;

a free ink chamber located above said floor;

a suspended ink chamber located above said floor and around said ink output port, said suspended ink chamber being separated from said free ink chamber;

at least one ink suspension body contained in said suspended ink chamber;

a fluid communication port formed between said free ink chamber and said suspended ink chamber to facilitate a fluid communication between said free ink chamber and said suspended ink chamber; and a filter device positioned to cover said fluid communication port, said filter device having a porosity selected to establish a desired bubbling pressure between said free ink chamber and said suspended ink chamber, wherein said at least one ink suspension body includes a first ink suspension body and a second ink suspension body, said first ink suspension body being positioned adjacent to and above said filter device, and said second ink suspension body having an ink transfer surface positioned adjacent to and above said ink output port.

2. The removable ink tank of claim 1, wherein said floor includes a first floor portion of said free ink chamber and a second floor portion of said suspended ink chamber, wherein a first elevation of said first floor portion of said free ink chamber is lower than a second elevation of said second floor portion of said suspended ink chamber.

3. The removable ink tank of claim 2, wherein said second floor portion of said suspended ink chamber includes a first sub-portion having said fluid communication port and a second sub-portion having said ink output port.

4. The removable ink tank of claim 3, wherein said filter device is positioned at an angle greater than zero with respect to horizontal.

5. The removable ink tank of claim 3, comprising:

an outwardly protruding end of said free ink chamber; and a snout extending downwardly from said second floor portion to define a location of said ink output port, wherein a distance between said outwardly protruding end of said free ink and said snout serves as a keying feature in association with a docking configuration of said printhead assembly.

6. The removable ink tank of claim 1, wherein said first ink suspension body having a smaller porosity than said second ink suspension body, and said first ink suspension body being positioned in contact with said second ink suspension body.

7. The removable ink tank of claim 1, wherein said filter device is oriented along a first plane and said ink transfer surface said second ink suspension body is oriented along a second plane, with said first plane being substantially parallel to and separated from said second plane by a height, and wherein said height is selected to define a desired ink flow rate burst amount of said suspended ink chamber.

8. The removable ink tank of claim 1, wherein said suspended ink chamber includes:

a lid having a vent; and a plurality side walls extending between said floor and said lid, wherein at least one of said plurality of side walls includes at least one elongate air path extending substantially from said lid near said vent to said floor near said filter device.

9. The removable ink tank of claim 1, wherein said filter device is one of stainless steel mesh screen, a plastic mesh screen, and a porous plate.

10. The removable ink tank of claim 1, wherein said porosity of said filter device is selected such that said bubbling pressure is a pressure selected in a range of about 4 to 10 $cmH_2O$.

11. An imaging apparatus, comprising:

a print engine having a printhead carrier;

a printhead assembly mounted to said printhead carrier; and a removable ink tank configured to be mounted to said printhead assembly, said removable ink tank, including:

a floor including an ink output port;

a free ink chamber located above said floor;

a suspended ink chamber located above said floor and around said ink output port, said suspended ink chamber being separated from said free ink chamber;

at least one ink suspension body contained in said suspended ink chamber;

a fluid communication port formed between said free ink chamber and said suspended ink chamber to facilitate a fluid communication between said free ink chamber and said suspended ink chamber; and a filter device positioned to cover said fluid communication port, said filter device having a porosity selected to establish a desired bubbling pressure between said free ink chamber and said suspended ink chamber, wherein said at least one ink suspension body includes a first ink suspension body and a second ink suspension body, said first ink suspension body being positioned adjacent to and above said filter device, and said second ink suspension body having an ink transfer surface positioned adjacent to and above said ink output port.

12. The imaging apparatus of claim 11, wherein said floor includes a first floor portion of said free ink chamber and a second floor portion of said suspended ink chamber, wherein a first elevation of said first floor portion of said free ink chamber is lower than a second elevation of said second floor portion of said suspended ink chamber.

13. The imaging apparatus of claim 12, wherein said second floor portion of said suspended ink chamber includes first sub-portion having said fluid communication port and a second sub-portion having said ink output port.

14. The imaging apparatus of claim 13, wherein said filter device is positioned at an angle greater than zero with respect to horizontal.

15. The imaging apparatus of claim 13, comprising:

an outwardly protruding end of said free ink chamber; and a snout extending downwardly from said second floor portion to define a location of said ink output port, wherein a distance between said outwardly protruding end of said free ink and said snout serves as a keying feature in association with a docking configuration of said printhead assembly.

16. The imaging apparatus of claim 11, wherein said first ink suspension body having a smaller porosity than said second ink suspension body, and said first ink suspension body being positioned in contact with said second ink suspension body.

17. The imaging apparatus of claim 11, wherein said filter device is oriented along a first plane and said ink transfer surface said second ink suspension body is oriented along a second plane, with said first plane being substantially parallel to and separated from said second plane by a height, and wherein said height is selected to define a desired ink flow rate burst amount of said suspended ink chamber.

18. The imaging apparatus of claim 11, wherein said suspended ink chamber includes:

a lid having a vent; and a plurality side walls extending between said floor and said lid, wherein at least one of said plurality of side walls includes at least one elongate air path extending substantially from said lid near said vent to said floor near said filter device.

19. The imaging apparatus of claim 11, wherein said filter device is one of stainless steel mesh screen, a plastic mesh screen, and a porous plate.

20. The imaging apparatus of claim 11, wherein said porosity of said filter device is selected such that said bubbling pressure is a pressure selected in a range of about 4 to 10 $cmH_2O$.

21. A removable ink tank configured to be mounted to a printhead assembly installed on an imaging apparatus, comprising:

a floor having an ink output port, said floor including a first floor portion and a second floor portion;

a free ink chamber located above said first floor portion;

a suspended ink chamber located above said second floor portion and around said ink output port, said suspended ink chamber being separated from said free ink chamber;

at least one ink suspension body contained in said suspended ink chamber;

a fluid communication port formed between said free ink chamber and said suspended ink chamber to facilitate a fluid communication between said free ink chamber and said suspended ink chamber; and a filter device positioned to cover said fluid communication port, said filter device having a porosity selected to establish a desired bubbling pressure between said free ink chamber and said suspended ink chamber, wherein said second floor portion of said suspended ink chamber includes a first sub-portion having said fluid communication port and a second sub-portion having said ink output port.

22. The removable ink tank of claim 21, wherein a first elevation of said first floor portion of said free ink chamber is lower than a second elevation of said second floor portion of said suspended ink chamber.

* * * * *